US006886224B2

(12) United States Patent
Sugiyama

(10) Patent No.: US 6,886,224 B2
(45) Date of Patent: May 3, 2005

(54) METHOD OF MAKING AN INK JET PRINTER HEAD

(75) Inventor: Jun Sugiyama, Sunto-gun (JP)

(73) Assignee: Toshiba TEC Kabushiki Kaisha, Tokyo (JP)

( * ) Notice: Subject to any disclaimer, the term of this patent is extended or adjusted under 35 U.S.C. 154(b) by 82 days.

(21) Appl. No.: 10/211,538

(22) Filed: Aug. 5, 2002

(65) Prior Publication Data

US 2003/0048335 A1 Mar. 13, 2003

(30) Foreign Application Priority Data

Aug. 24, 2001 (JP) ..... 2001-254139

(51) Int. Cl.[7] ..... B21D 53/76

(52) U.S. Cl. ..... 29/25.35; 29/890.1; 29/846; 347/71; 347/72

(58) Field of Search ..... 29/25.35, 890.1, 29/846, 847, 852; 347/68, 71, 72; 205/93; 204/224 R

(56) References Cited

U.S. PATENT DOCUMENTS 2,590,927 A * 4/1952 Brandt et al. ..... 204/224 R X
5,024,735 A * 6/1991 Kadija ..... 205/93 X
5,731,048 A 3/1998 Ashe et al.
5,914,739 A 6/1999 Zhang
5,933,169 A 8/1999 Sugahara

FOREIGN PATENT DOCUMENTS

| | | | |
|---|---|---|---|
| EP | 0 734 865 | 10/1996 | |
| EP | 0 757 939 | 12/1997 | |
| EP | 0 968 823 | 1/2000 | |
| JP | 3-50786 | * 3/1991 | ..... 29/846 |
| JP | 5-27528 | * 10/1993 | ..... 29/846 |
| JP | 11-349886 | 12/1999 | |
| JP | 2001-85445 | 3/2001 | |
| JP | 2001-85447 | 3/2001 | |
| JP | 2001-162201 | 6/2001 | |

* cited by examiner

*Primary Examiner*—A. Dexter Tugbang
(74) *Attorney, Agent, or Firm*—Oblon, Spivak, McClelland, Maier & Neustadt, P.C.

(57) ABSTRACT

An ink jet printer head fabricating method includes forming electrodes on surfaces of plural grooves by an electroless plating method using a wet process, the plural grooves being formed in a laminate substrate of two piezo electric members, cutting a portion of the laminate substrate with a dicing saw, and subsequently removing burrs of the electrodes by brushing with a brushing device. Burrs of the electrodes formed on the surfaces of the grooves are removed by the brushing without chipping or cracking of the electrodes, thereby preventing defects in ink ejection.

9 Claims, 6 Drawing Sheets

METHOD OF MAKING AN INK JET PRINTER HEAD

CROSS REFERENCE TO RELATED APPLICATION

The present application is based on Japanese Priority Document 2001-254139 filed on Aug. 24, 2001.

BACKGROUND OF THE INVENTION

1. Field of the Invention

The present invention relates to an ink jet printer head and a method for fabricating the same. This ink jet printer head uses a piezoelectric member as an actuator to eject ink.

2. Description of the Background

An ink jet printer head fabricating method as a background of the present invention will be described below with reference to FIG. 4.

This ink jet printer head fabricating method comprises the following first to seventh steps.

(1) First Step

First, as shown in FIG. 4(A), a laminate substrate 44 of a two-layer structure is fabricated by bonding two plate-like piezoelectric members 42 and 43. The piezoelectric members 42 and 43, which are polarized in the plate thickness direction, are bonded together so that the respective polarization directions are opposite to each other.

(2) Second Step

Next, as shown in FIG. 4(B), grinding is performed for the laminate substrate 44 to form plural grooves 45 having a depth reaching the interior of the piezoelectric member 43 in a surface of the piezoelectric member 42, and support walls 46 each positioned between adjacent grooves 45. The grinding is performed using, for example, a dicing saw or a diamond wheel, which are used in cutting an IC wafer. The size of each groove 45 is determined, for example, in accordance with the specification of an ink jet printer head 41.

(3) Third Step

Then, as shown in FIG. 4(C), by an electroless plating method using a wet process, electrodes 47 are formed on surfaces of the grooves 45 and wiring patterns 48 are formed on a plane of the piezoelectric member 42.

(4) Fourth Step

Further, as shown in FIG. 4(D), a top plate 49 having a recess is bonded to the surface side (the piezoelectric member 42 side) of the laminate substrate 44 so as to cover the grooves 45 serving as ink flowing passages and also cover the support walls 46, thereby forming pressure chambers and a common ink chamber. In this way there is formed a head 41*a*.

(5) Fifth Step

Next, as shown in FIG. 4(E), in order to obtain a predetermined pressure chamber length, an end face of the head 41*a*, which end face is located on an open side of the grooves 45, is cut off using a dicing saw.

(6) Sixth Step

At this time, since burrs of the electrodes 47 formed in the grooves 45 is generated in a cut section of the head 41*a*, the burrs are removed by lapping or grinding.

(7) Seventh Step

Then, as shown in FIG. 4(F), an orifice plate 52 preformed with plural ink ejecting holes 51 corresponding to the grooves 45 is bonded to the head 41*a* to afford an ink jet printer head 41.

In the above ink jet printer head fabricating method, the head 41*a* is cut off with a dicing saw or the like on the side where it is bonded to the orifice plate 52, in order to form predetermined pressure chambers, (the fifth step). Since, in the cut section of the laminate substrate 44, there occur such burrs of the electrodes 47 as shown in FIG. 5, the burrs are removed by lapping or grinding (the sixth step).

However, if an attempt is made to remove the burrs by lapping, there occur chipping and cracking in the portions of the grooves 45 and support walls 46 which portions face the cut section of the laminate substrate, as shown in FIG. 6. Thus, it is impossible to remove the burrs completely. Likewise, if an attempt is made to remove the burrs by grinding, the burrs of the electrodes 47 will be enlarged, with consequent fear of the burrs being bent inwards of the grooves 45, as shown in FIG. 7.

It has turned out that if the orifice plate 52 is bonded to the head 41*a* in such a state, burrs 47*a* may project into or completely close the ink ejecting holes 51. When ink was ejected from the ink jet printer head 41 in such a state, there occurred defects in ink ejection such as misdirection, i.e., failure to make a straight flying of ink droplets, or unstable flying or non-flying of ink.

SUMMARY OF THE INVENTION

It is an object of the present invention to completely remove burrs of electrodes provided on surfaces of grooves formed in a substrate, without the occurrence of chipping or cracking of the electrodes, and thereby provide an ink jet printer head of a high quality not causing such defects in ink ejection as misdirection, i.e., failure to make a straight flying of ink droplets, and unstable flying or non-flying of ink during ink ejection.

The above object of the present invention is achieved by a novel ink jet printer head and a novel fabrication method for the head according to the present invention.

The ink jet printer head according to the present invention is provided with a substrate, the substrate comprising a piezoelectric member and formed with plural grooves. A top plate is disposed above the plural grooves and on support walls each formed between adjacent such grooves, thereby defining pressure chambers and a common ink chamber. Electrodes are formed on surfaces of the grooves. Surfaces of the electrodes, which surfaces are located on surface sides of the grooves, are in contact with the surfaces of the grooves throughout the electrodes' surfaces, so that burrs of the electrodes are all removed without causing chipping or cracking of the electrodes, and defects in ink ejection such as misdirection, i.e., failure to make a straight flying of ink droplets, and unstable flying of ink.

In another aspect of the present invention there is provided an ink jet printer head fabricating method, wherein electrodes are formed on surfaces of plural grooves formed in a substrate, the substrate comprising a piezoelectric member, and a top plate is disposed above the plural grooves and on support walls each formed between adjacent such grooves to define pressure chambers and a common ink chamber. After the formation of the electrodes, an end face portion of the substrate located on an open side of the grooves is cut off and the resulting cut section of the substrate is subjected to brushing with a brush to remove burrs of the electrodes. The electrodes' burrs proved to be removed completely without chipping or cracking of the electrodes. Thus, such defects in ink ejection as misdirection, i.e., failure to make a straight flying of ink droplets, and unstable flying of ink do not occur.

BRIEF DESCRIPTION OF THE DRAWINGS

A more complete understanding of the present invention and many advantages brought about by the present invention will be obtained easily as the invention is better understood by reference to the following detailed description when taken in conjunction with the accompanying drawings, in which.

DETAILED DESCRIPTION OF THE INVENTION

An embodiment of the present invention will be described in detail hereinunder.

Reference will first be made to an ink jet printer head fabricating method embodying the present invention.

Figure 1:
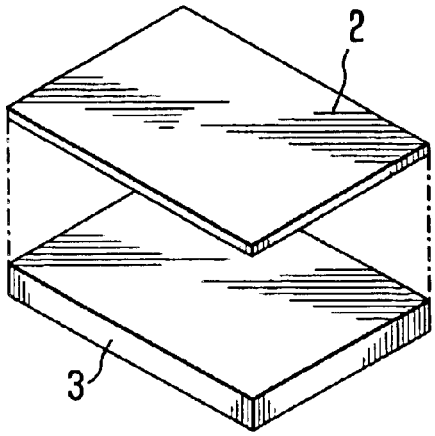
FIG. 1(A) is an explanatory diagram explaining a first step in an ink jet printer head fabricating method according to an embodiment of the present invention.
FIG. 1(B) is an explanatory diagram explaining a second step in the ink jet printer head fabricating method.
FIG. 1(C) is an explanatory diagram explaining a third step in the ink jet printer head fabricating method.
FIG. 1(D) is an explanatory diagram explaining a fourth step in the ink jet printer head fabricating method.
FIG. 1(E) is an explanatory diagram explaining a fifth step in the ink jet printer head fabricating method.
FIG. 1(F) is an explanatory diagram explaining a seventh step in the ink jet printer head fabricating method.
Figure 1:
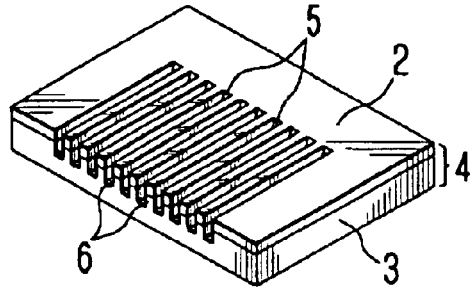
Figure 1:
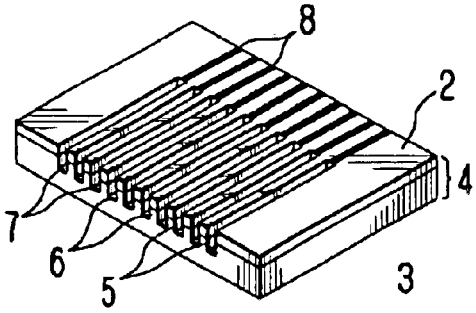
Figure 1:
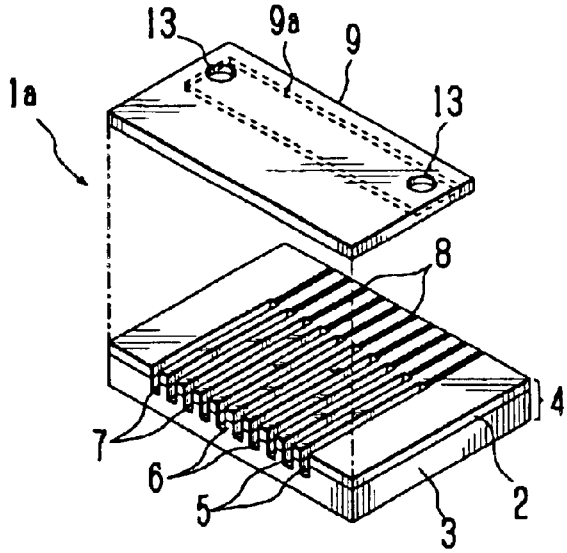
Figure 1:
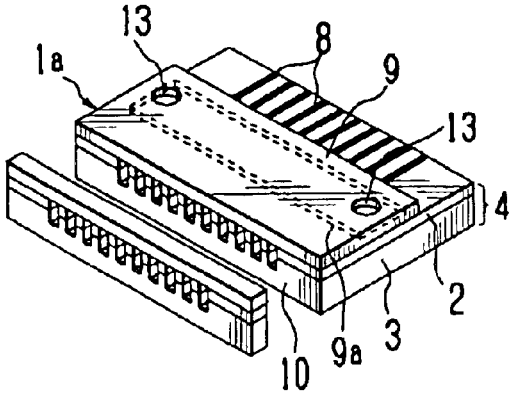
Figure 1:
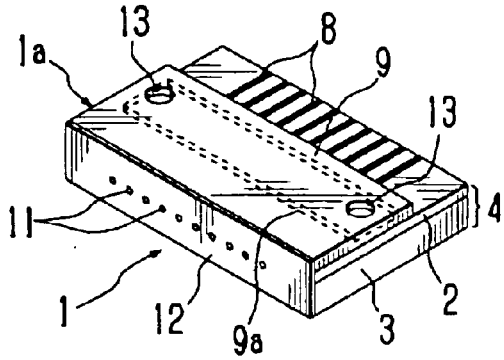

FIG. 1 is an explanatory diagram explaining the ink jet printer head fabricating method step by step. This method comprises the following first to seventh steps.

(1) First Step

First, as shown in FIG. 1(A), two plate-like piezoelectric members 2 and 3 are bonded together to fabricate a laminate substrate 4 having a two-layer structure of both piezoelectric members. The piezoelectric members 2 and 3 are polarized in their plate thickness direction. The bonding of the piezoelectric members 2 and 3 is performed so that both piezoelectric members are opposite to each other in the direction of polarization.

(2) Second Step

Next, as shown in FIG. 1(B), the laminate substrate 4 is subjected to grinding to form plural grooves 5 and support walls 6 each positioned between adjacent grooves 5 on a surface side of the laminate substrate 4 (on the piezoelectric member 2 side), the grooves 5 having a depth reaching the interior of the piezoelectric member 3 from a surface of the piezoelectric member 2. This grinding work can be done using a dicing saw which is used for cutting an IC wafer. The size of each groove 5 is determined in accordance with, for example, the specification of the ink jet printer head to be fabricated.

(3) Third Step

Then, as shown in FIG. 1(C), electrodes 7 are formed on inner surfaces of the grooves 5 and wiring patterns 8 are formed on a plane of the piezoelectric member 2.

(4) Fourth Step

Further, as shown in FIG. 1(D), a top plate 9 having a recess 9*a* formed on one side thereof is bonded to the surface side (the piezoelectric member 3 side) of the laminate substrate 4 so as to cover on the recess 9*a*-formed side the grooves 5 which serve as ink flowing passages and the support walls 6. As a result, spaces surrounded with the recess 9*a*-free surface portion of the top plate 9 and the grooves 5 serve as pressure chambers and a space surrounded with the recess 9*a* and the grooves 5 serves as a common ink chamber. In this way there is formed a head 1*a*.

(5) Fifth Step

Next, as shown in FIG. 1(E), an end face of the head 1*a* is cut off on an open side of the grooves 5 by means of a dicing saw to give a predetermined pressure chamber length for the pressure chamber formed in the fourth step.

(6) Sixth Step

Figure 2:
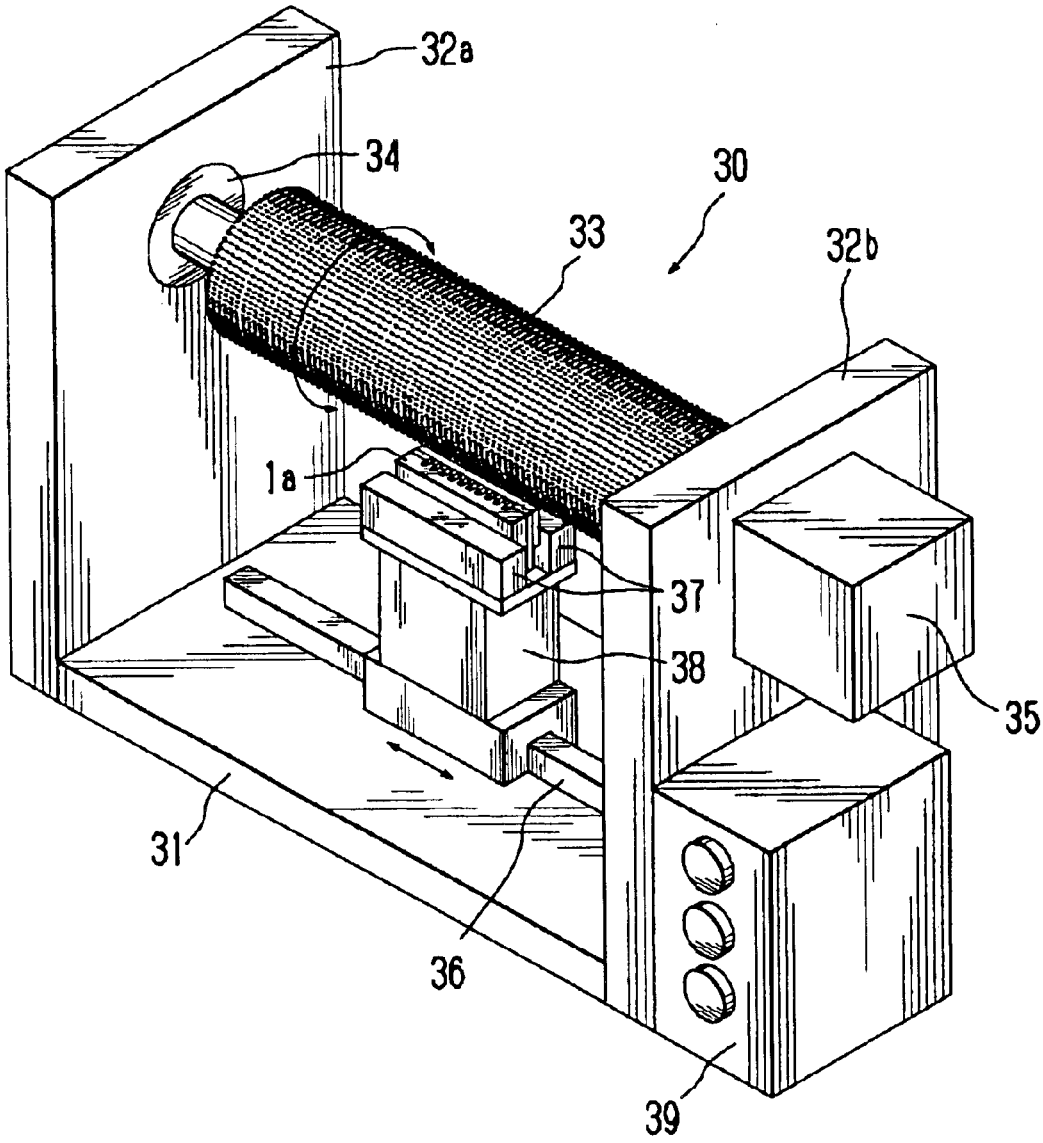
FIG. 2 is a perspective view of a brushing device used in a sixth step in the ink jet printer head fabricating method.

Burrs 7*a* of the electrodes 7 are removed using such a brushing device 30 as shown in FIG. 2. The details of this sixth step and the construction of the brushing device 30 will be described later.

(7) Seventh Step

Further, as shown in FIG. 1(F), an orifice plate 12 is bonded to the head la to complete an ink jet printer head 1. The orifice plate 12 is pre-formed with plural orifices 11 as ink ejecting holes corresponding to the grooves 5.

The brushing device 30 used in the above sixth step is of the following construction. A roll-like brush 33 is jounaled through bearings 34 in two side plates 32*a* and 32*b* supported by a base plate 31. The brush 33 is connected to a motor 35. On the base plate 31 is laid a rail 36 extending in the direction of the length between both side plates 32*a* and 32*b*. A vertically movable stage 38 is installed on the rail 36 and a head holder 37 is provided on the stage 38. The motor 35 is controlled by a controller box 39, whereby the brush 33 can be rotated in both forward and reverse directions and its rotating speed can also be changed. With the motor 35 as a drive source, the stage 38 can move on the rail 36. The controller box 39 also makes control to change the moving speed and moving axis direction of the stage 38.

The operation for removing the burrs 7*a* of the electrodes 7 in the head la in the sixth step is carried out in the following manner. The head 1*a* is held with the head holder 37 and the stage 38 is adjusted so that the brush 33 comes into abutment against a cut section 10 of the head 1*a*. At this time, the amount of the brush 33 to be pressed against the cut section of the head (i.e., a difference between the length from a base end to a tip of the brush 33 when deflected upon abutment of the brush tip against the surface to be brushed and the length from the brush base end to the tip in a completely contactless state of the brush tip with the to-bebrushed surface) is set to a desired value by adjusting the height of the stage 38. Next, the brush 33 is rotated by the controller box 39 and the stage 38 is moved on the rail 36.

As an example, the burrs 7*a* were removed using as the brush 33 a nylon brush having a brush external size of $\phi$25 mm and a brush element diameter of 50 $\mu$m and under the conditions of rotating speed 13000 rpm and moving speed 30 mm/sec of the stage 38 on the rail 36. In this connection, when brushing with the brush 33 was performed in only one direction for the cut section 10, a certain degree of deburring effect was obtained, but when the brushing was performed in both directions, the burrs 7*a* could be removed completely.

Figure 3:
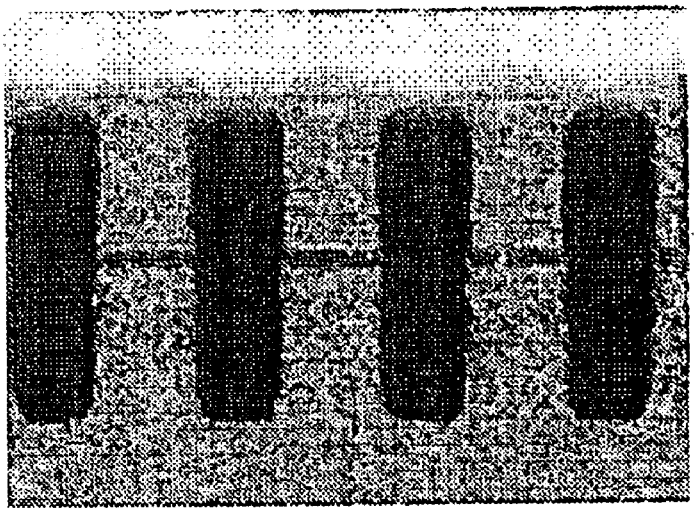
FIG. 3 is an enlarged diagram of a cut section of a laminate substrate after deburring performed in the sixth step in the ink jet printer head fabricating method.
Figure 4A:
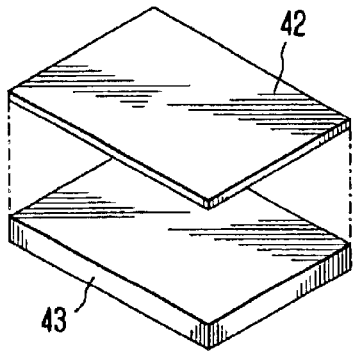
PRIOR ART Fig. 4(A)
FIG. 4(A) is an explanatory diagram explaining a first step in an ink jet printer head fabricating method as a background of the present invention.
Figure 4B:
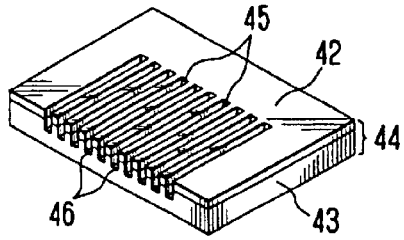
PRIOR ART Fig. 4(B)
FIG. 4(B) is an explanatory diagram explaining a second step in the background method.
Figure 4C:
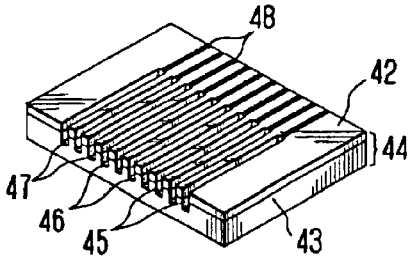
PRIOR ART Fig. 4(C)
FIG. 4(C) is an explanatory diagram explaining a third step in the background method.
Figure 4D:
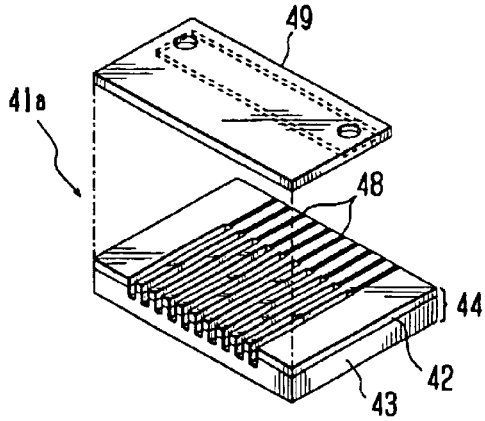
PRIOR ART Fig. 4(D)
FIG. 4(D) is an explanatory diagram explaining a fourth step in the background method.
Figure 4E:
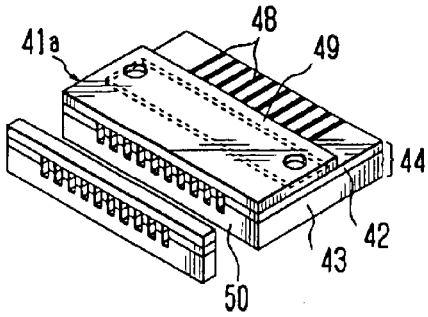
PRIOR ART Fig. 4(E)
FIG. 4(E) is an explanatory diagram explaining a fifth step in the background method.
Figure 4F:
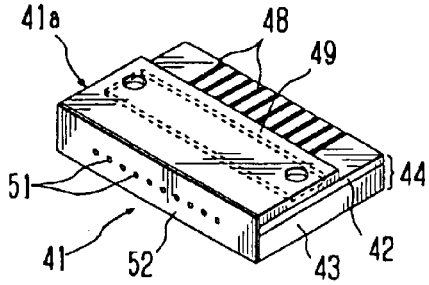
PRIOR ART Fig. 4(F)
FIG. 4(F) is an explanatory diagram explaining a seventh step in the background method.
Figure 5:
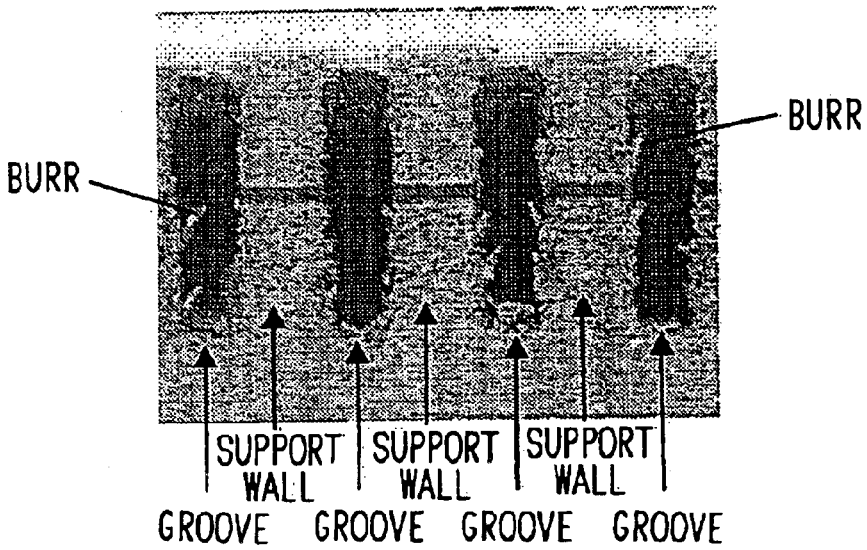
FIG. 5 is an enlarged diagram of a cut section of a laminate substrate after cutting off an end face thereof on an open side of grooves in the fifth step in the background method.
Figure 6:
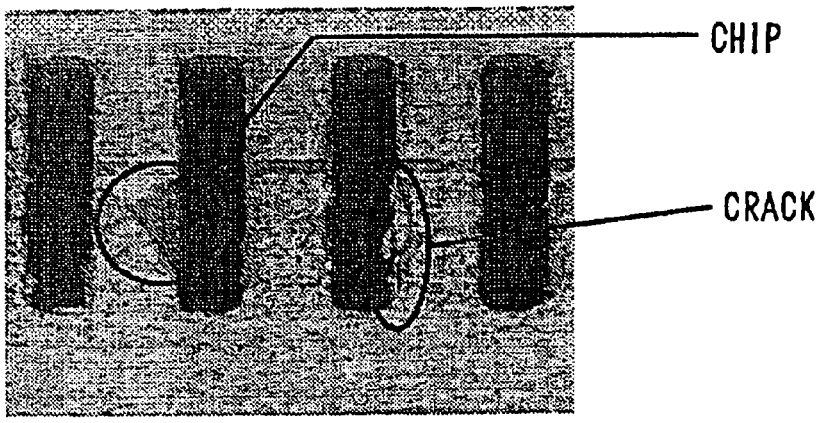
FIG. 6 is an enlarged diagram of the cut section of the laminate substrate after deburring in a sixth step in the background method.
Figure 7:
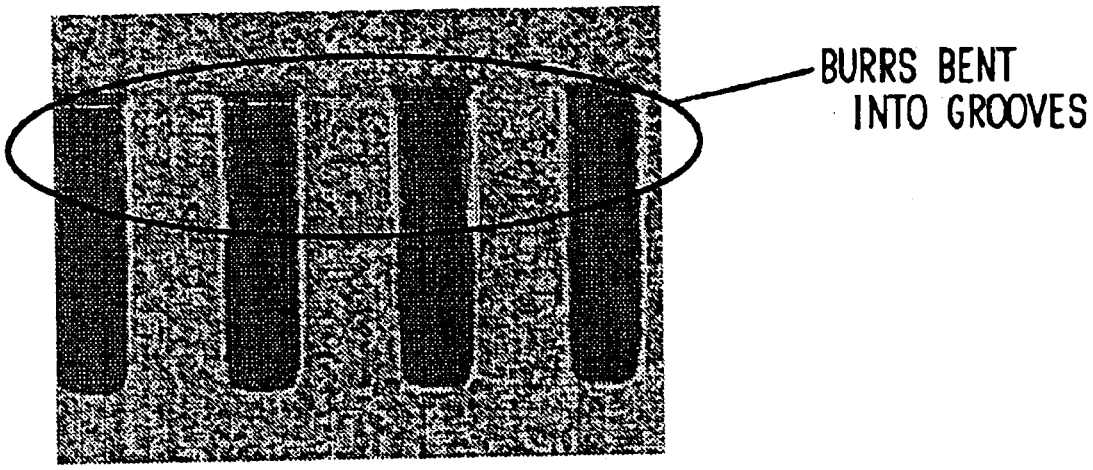
FIG. 7 is an enlarged diagram of the cut section of the laminate substrate after deburring in the sixth step in the background method.

The cut section 10 of the head 1*a* with the burrs 7*a* of the electrodes 7 thus removed using the brushing device 30 under the above conditions is shown on a larger scale in FIG. 3. A comparison of FIG. 3 with the foregoing FIGS. 6 and 7 shows that in the cut section 10 there is found no chipping of the support walls 6 nor is found bending of the burrs 7*a* into the grooves 5 and that the electrodes 7 are in a completely deburred state.

In this example, the amount of the brush 33 pressed against the cut section during brushing with the brush 33 was changed stepwise in the range of 0.5 to 3.0 mm to remove the burrs 7*a*. The following results were obtained.

(a) When the amount of the brush 33 pressed against the cut section was set at 3.0 mm, there was recognized little deburring effect and a slight damage of support walls 6 between grooves 5 caused by brushing with the brush 33 was recognized.

(b) When the amount of the brush 33 pressed against the cut section was set at 2.5 mm, a certain deburring effect was recognized in comparison with when the amount was set at 3.0 mm, but the effect was still unsatisfactory.

(c) When the amount of the brush 33 pressed against the cut section was set at 2.0 mm, the burrs 7*a* were removed to a satisfactory extent, but much time was required for the brushing with the brush 33 and thus the mass productivity of the brushing work was low.

(d) When the amount of the brush 33 pressed against the cut section was set at 1.5 mm, the burrs 7*a* were removed to a satisfactory extent as is the case when the amount was set at 2.0 mm. But much time was required for the brushing with the brush 33 and thus the mass productivity of the brushing work was low.

(e) When the amount of the brush 33 pressed against the cut section was set at 1.0 mm, there was obtained a satisfactory effect of removing the burrs 7*a*. Besides, the brushing with the brush 33 could be done in a short time and the mass productivity of the brushing work was high.

(f) When the amount of the brush 33 pressed against the cut section was set at 0.5 mm, there was obtained a satisfactory effect of removing the burrs 7*a*. Besides, the brushing with the brush 33 could be done in a short time and the mass productivity of the brushing work was the highest.

As is seen from the above results, when the amount of the brush 33 pressed against the cut section 10 was set at a value of not larger than 2.0 mm in a contacted state of the brush 33 with the cut section, it is possible to obtain a satisfactory effect of removing the burrs 7*a*, but when mass productivity based on shortening of the time required for the brushing work is taken into account, it is desirable that the amount of the brush pressed against the cut section be set at a value of not larger than 1.0 mm.

Although in this embodiment the electrodes 7 are formed by the electroless plating method using a wet process, they may be constituted by thick-film electrodes formed by a sputtering method using a dry process or sticky metallic electrodes using gold.

According to the ink jet printer head fabricating method of this embodiment it is possible to completely remove the burrs of the electrodes 7 formed on the surfaces of the grooves 5, without causing chipping or cracking of the electrodes, and prevent such defects in ink ejection as misdirection, i.e., failure to make a straight flying of ink droplets, and unstable flying of ink, in the ink jet printer head 1 after the fabrication.

The following description is now provided about the ink jet printer head embodying the present invention.

The ink jet printer head 1 fabricated in the above manner is shown in FIG. 1(F) and has the following construction. The ink jet printer head 1 is provided with a laminate substrate 4, the laminate substrate 4 being constituted by a piezoelectric member and formed with plural grooves 5. The laminate substrate 4 has a two-layer laminate structure formed by bonding two plate-like piezoelectric members 2 and 3 so as to be opposite to each other in the direction of polarization, the piezoelectric members 2 and 3 being polarized in their plate thickness direction. The grooves 5 are formed in a surface of the laminate substrate 4 so as to have a depth which reaches the interior of the piezoelectric member 3 from a surface of the piezoelectric member 2, with support walls 6 being formed each between adjacent grooves 5. Electrodes 7 are formed on surfaces of the grooves 5. Since burrs 7*a* are completely removed as described above, surfaces of the electrodes 7 which surfaces are located on the surface side of the grooves 5 are in contact throughout their surfaces with the surfaces of the grooves.

Wiring patterns 8 connected to the electrodes 7 are formed on a plane of the laminate substrate on the piezoelectric 2 side. A top plate 9 is disposed above the grooves 5 and on the support walls 6 each formed between adjacent grooves 5 to define pressure chambers and a common ink chamber. An orifice plate 12 is attached to an end face of the laminate substrate 4 which end face is located on an open side of the grooves 5. The orifice plate 12 is formed with plural orifices 11 corresponding respectively to the grooves 5. Ink holes 13 for the supply of ink to the ink chamber are formed in the top plate 9.

According to the ink jet printer 1 of this embodiment, since the burrs of the electrodes 7 are all removed without chipping or cracking of the electrodes and the electrodes 7 are in contact with the surfaces of the grooves 5 throughout their surfaces located on the surface side of the grooves, it is possible to prevent the occurrence of defects in ink ejection such as misdirection, i.e., failure to make a straight flying of ink droplets, and unstable flying of ink.

Obviously many modifications and variations of the present invention are possible in the light of the above teachings. It is therefore to be understood that within the scope of the appended claims the invention may be practiced otherwise than as specifically described.

What is claimed is:

1. A method for fabricating an ink jet printer head, comprising the steps of:

forming electrodes on surfaces of plural grooves, the plural grooves being formed in a piezoelectric member of a substrate;

disposing a top plate above the plural grooves and on support walls each formed between the adjacent grooves to define pressure chambers and a common ink chamber;

cutting off an end face side of the substrate in which an end face is located on an open side of the grooves;

brushing a resulting cut section of the substrate with a rotating brush to remove burrs of the electrodes; and attaching a plate to the cut section of the substrate, the plate being formed with a plurality of orifices for the ejection of ink which orifices correspond respectively to the grooves.

2. An ink jet printer head fabricating method according to claim 1, wherein the step of removing the burrs comprises performing the brushing in a contacted state of the brush with the cut section of the substrate located on the open side of the grooves and while setting the an amount of the brush pressed against the cut section of the substrate at a value of not larger than 2.0 mm.

3. An ink jet printer head fabricating method according to claim 1, wherein the step of removing the burrs comprises performing the brushing in a contacted state of the brush with the cut section of the substrate located on the open side of the grooves and while setting an amount of the brush pressed against the cut section of the substrate at a value of not larger than 1.0 mm.

4. An ink jet printer head fabricating method according to claim 1, wherein the step of forming the electrodes is carried out by an electroless plating method using a wet process.

5. An ink jet printer head fabricating method according to claim 1, wherein the step of forming the electrodes is carried out by a sputtering method using a dry process.

6. An ink jet printer head fabricating method according to claim 1, wherein the step of forming the electrodes not only forms the electrodes but also forms wiring patterns on a surface of the substrate.

7. An ink jet printer head fabricating method according to claim 1, further comprising the steps of:

before the step of forming the electrodes, bonding two plate-like piezoelectric members together which are polarized in their thickness direction, the bonding being performed so that the two piezoelectric members are opposite to each other in their polarizing direction, to form the substrate; and after the step of forming the substrate and before the step of forming the electrodes, subjecting the substrate to a grinding work to form the plural grooves and support walls on a surface of the substrate, the grooves having a depth extending from a surface of one of the piezoelectric members and reaching an interior of the other of the two piezoelectric members.

8. The method of claim 1, wherein the rotating brush is a dry brush.

9. A method for fabricating an ink jet printer head, comprising:

forming an electrode on a surface of a groove, the groove being formed in a piezoelectric member of a substrate;

placing a top plate above the groove on a support wall to define a pressure chamber and a common ink chamber;

cutting a cut on an end face side of the substrate on an open side of the groove;

brushing the cut with a dry brush to remove a burr in the cut; and attaching a plate to the cut section of the substrate, the plate having an orifice corresponding to the groove for ink ejection.

* * * * *